United States Patent [19]

Rodgers

[11] 4,219,233

[45] Aug. 26, 1980

[54] CHAIR SEAT BACK TILT-ADJUSTING MECHANISM

[75] Inventor: William C. Rodgers, Stamping Ground, Ky.

[73] Assignee: Hoover Universal, Inc., Saline, Mich.

[21] Appl. No.: 949,686

[22] Filed: Oct. 10, 1978

[51] Int. Cl.[2] ..... A47C 3/00

[52] U.S. Cl. ..... 297/300; 297/306

[58] Field of Search ..... 297/300, 304, 305, 306, 297/301

[56] References Cited

U.S. PATENT DOCUMENTS

| | | | |
|---|---|---|---|
| 1,113,833 | 10/1914 | Ruff | 297/305 |
| 1,986,105 | 1/1935 | Foote | 297/304 X |
| 3,966,252 | 6/1976 | Albinson | 297/306 |
| 4,065,176 | 12/1977 | Foutana | 297/304 |
| 4,067,610 | 1/1978 | Doerr et al. | 297/301 |

*Primary Examiner*—Francis K. Zugel

*Attorney, Agent, or Firm*—Olsen and Stephenson

[57] ABSTRACT

A chair seat back tilt-adjusting mechanism for use in swivel-type chairs wherein a seat back member is pivotally movable relative to a seat member. The mechanism includes a frame assembly, on which the seat back is supported, pivotally mounted on a support member, which is in turn yieldably movable relative to the seat member. Coacting nut and bolt means are secured to the support member and to the frame assembly so that operation of the nut and bolt means results in pivoting of the frame assembly about a horizontal axis with respect to the support member, thereby moving the seat back to an adjusted position.

2 Claims, 5 Drawing Figures

CHAIR SEAT BACK TILT-ADJUSTING MECHANISM

BACKGROUND OF THE INVENTION

U.S. Pat. No. 4,067,610, owned by the assignee of this invention, shows a chair control mechanism employing a torsion bar having a body portion extending longitudinally of the chair seat and end portions which extend tranversely of the body portion to yieldably resist pivotal movement of two components relative to each other. A torsion bar adjustment member is engageable with one of the end portions of the torsion bar and is operable to preload the torsion bar and thereby adjust the magnitude of the resistance to pivotal movement. The present invention constitutes an improvement on the chair control mechanism shown in the aforementioned patent.

In swivel-type chairs in which the chair back is pivotable relative to the seat, control mechanisms, such as the one shown in U.S. Pat. No. 4,067,610, are utilized to control the force required to tilt the chair back relative to the seat. Torsion bars are commonly utilized in the chair controls to yieldably resist such tilting movement and thus control the force requirements. Such chair control mechanisms have been used satisfactorily in the past. However, it has been discovered that as a result of "creep", which inevitably occurs in the torsion bars, further seat adjustment capability is desirable. "Creep" is a phenomenon in which permanent physical deformations of the metal occur due to prolonged exposure to stress. Such deformations can cause a decrease in the load-supporting capabilities of the chair and undesirable relaxation of the seat back.

Variations in user comfort demands have dictated that the resting (no-load) position of the seat back be adjustable to various positions. For example, a person who is typing will normally lean forward in the chair and prefer that the seat back provide firm support. A person normally leaning back in the chair may require less initial support. It is an object of the present invention, therefore, to provide a seat back tilt-adjusting mechanism to be used in cooperation with conventional chair control mechanisms to overcome the problems of creep and increase user comfort.

SUMMARY OF THE INVENTION

The seat back tilt-adjusting mechanism of this invention includes a frame assembly adapted to support the chair seat back pivotally mounted on a support member, which is in turn yieldably movable relative to the chair seat. A nut and bolt assemblies is secured to the support member and to the frame assembly so that operation of the nut and bolt assembly tends to move the frame about a horizontal axis with respect to the support member. A clamp wheel secured to the nut provides convenient means for operating the assembly. The invention thus provides an efficient means of adjusting the degree of tilt of the chair seat back according to the dictates of user comfort.

The seat back tilt-adjusting mechanism of this invention is particularly useful when used in cooperation with chair control mechanisms employing torsion bars which extend longitudinally of the chair seat. Such mechanisms are advantages because they are compact and of low profile. The tilt-adjusting mechanism can be operated to compensate for seat back relaxation caused by creep. The tilt-adjusting mechanism provides further advantages when used in cooperation with a torsion bar adjustment member, such as the one shown in U.S. Pat. No. 4,067,610. To compensate for creep, the torsion bar adjustment member can be operated to increase the resistance offered by the torsion bar, and the tilt-adjusting mechanism can be operated to move the seat back to an acceptable degree of tilt. Furthermore, the torsion bar adjustment member and the tilt-adjusting mechanism can be operated cooperatively to provide a plurality of seat back positions and tilt rates in accordance with user comfort requirements.

The invention thus provides a convenient and efficient means of controlling seat back tilt to conform to user comfort demands and increase the load-supporting capabilities of the chair.

Further objects, features, and advantages of this invention will become apparent from a consideration of the following description, the appended claims, and the accompanying drawing in which:

Figure 1:
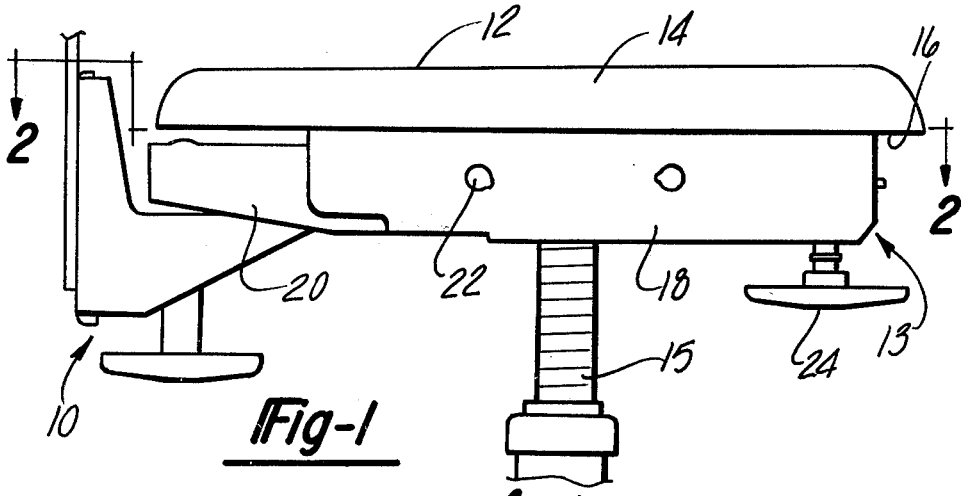
FIG. 1 is a side view of the seat back tilt-adjusting mechanism of this invention shown in assembly relation with a swivel-type chair.
Figure 4:
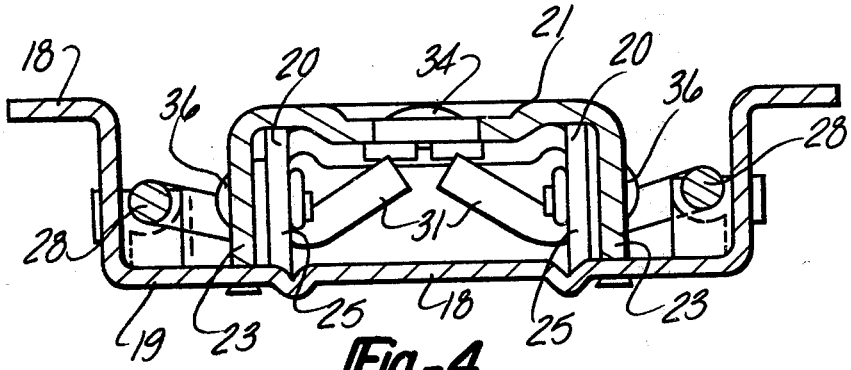
FIG. 4 is an enlarged transverse sectional view of the mechanism as seen from the line 4—4 in FIG. 2.

With reference to the drawing, the seat back tilt-adjusting mechanism of this invention, indicated generally at 10, is illustrated in FIG. 1 in assembly relation with a swivel-type chair 12, and a chair control mechanism, indicated generally at 13, of the type shown in U.S. Pat. No. 4,067,610. The chair 12 includes a seat member 14 which has an underside 16, a wheeled base (not shown), and an upright pedestal 15 which extends between the base and the seat member 14. The chair control mechanism 13 includes a frame member 18 secured to the underside 16 the seat 14 and which is supported on the pedestal 15, a support member 20 pivotally mounted on the frame member 18 for rotation about a horizontal axis 22, and a torsion bar adjustment member 24 carried by the frame 18. The frame member 18 is U-shaped in cross section, and has a bottom portion 19 to which a bracket 21 is secured (FIG. 4). The bracket 21 has a substantially inverted U-shape cross section and includes a pair of upright legs 23. The support member 20 has similar legs 25 which are mounted on the bracket legs 23 by rivets 36 which allow pivotal movement of the support member 20 about the axis 22.

Figure 2:
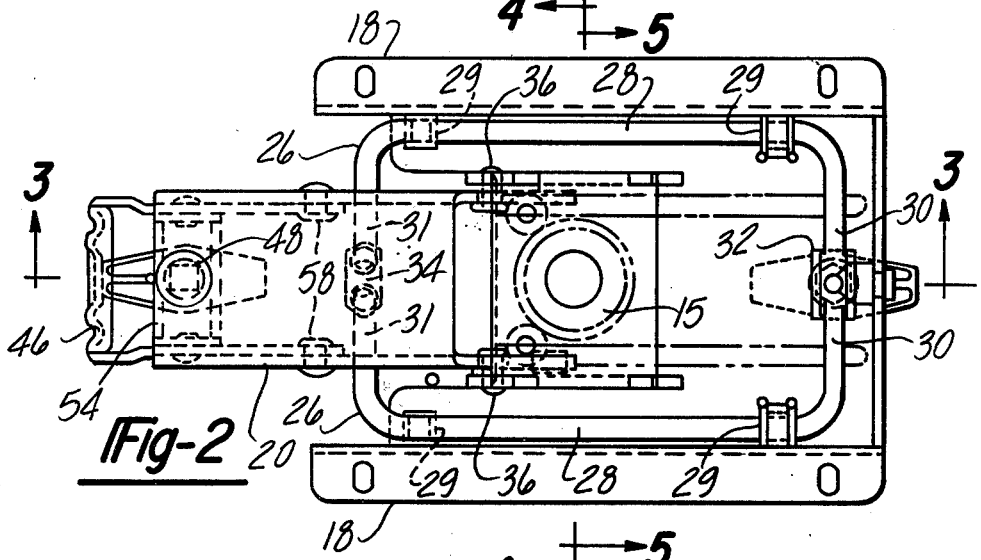
FIG. 2 is a plan view of the seat back tilt-adjusting mechanism as seen from substantially the line 2—2 in FIG. 1.

As seen in FIG. 2, a pair of torsion bars 26 provide yieldable support of the support member 20 on the frame member 18. Each torsion bar 26 has a main body portion 28 which extends longitudinally of the chair seat 14 and end portions 30 and 31 which extend transversely of the body portion 28. A plurality of bearing blocks 29 are provided on the frame member 18 to secure the torsion bars 26 thereto while allowing rotation of the body portions 28 about a longitudinal axis. End portions 30 at one end of the frame member 18 are secured thereto by means of a bracket assembly 32. End portions 31 located at the opposite end of the frame member 18 are positioned below the support member 20 and abut against a wear button 34 carried by the support member 20, so that downward movement of the support member 20 causes the end portions 31 to rotate downwardly.

Figure 3:
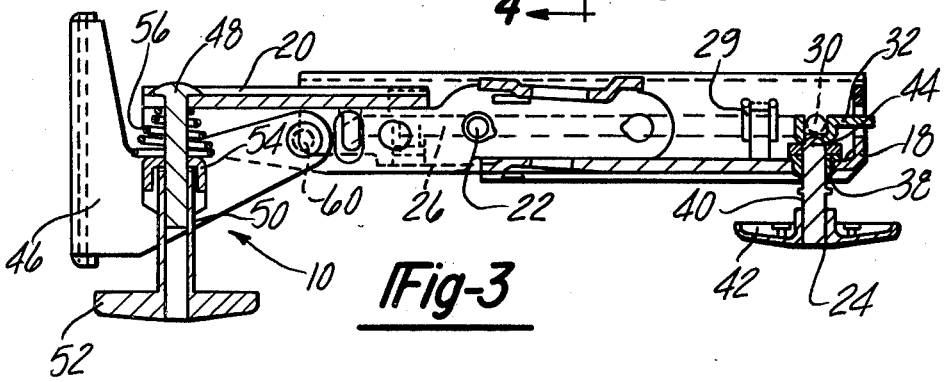
FIG. 3 is a longitudinal sectional view of the tilt-adjusting mechanism as seen from substantially the line 3—3 in FIG. 2.
Figure 5:
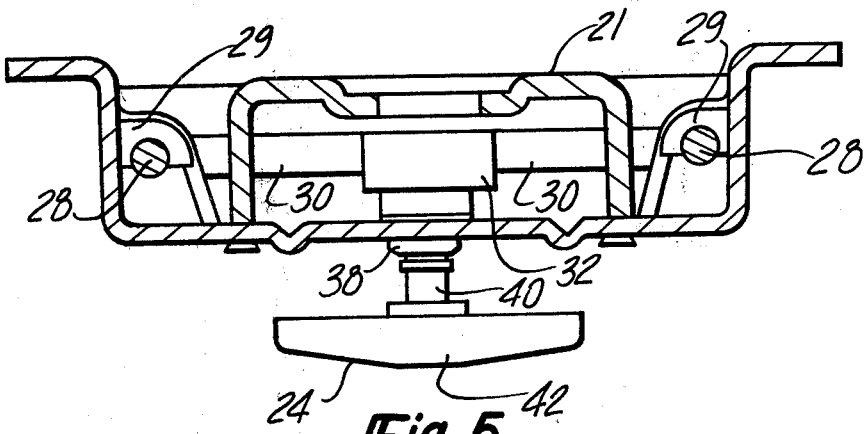
FIG. 5 is an enlarged transverse sectional view of the mechanism as seen from the line 5—5 in FIG. 2.

As seen in FIGS. 3 and 5, the torsion bar adjustment member 24 comprises a nut 38 secured to the frame member 18, a bolt 40 threadably mounted in the nut 38, and a clamp wheel 42 secured to the bolt 40. The bolt 40 has an end portion 44 which engages the bracket assembly 32 so that upward movement of the bolt 40 in response to turning of the clamp wheel 42 causes the end portions 30 of the torsion bars 26 to rotate upwardly, thus preloading the torsion bars 26.

The seat back tilt-adjusting mechanism seen at 10 in FIGS. 2 and 3 comprises a frame assembly 46, on which the chair seat back (not shown) is supported, a bolt 48 secured to the support member 20, a nut 50 threadably mounted on the bolt 48 and having a clamp wheel 52 secured to one end thereof, a bracket assembly 54 which is secured to the frame assembly 46 and is positioned on the nut 50, and spring means 56 located on the support member 20 which tend to force the bracket assembly 54 downwardly on the nut 50. Rivets 58 provide support for the frame assembly 46 on the support member 20 so that the frame 46 is pivotally movable relative to the support member 20 about a horizontal axis 60. Upward movement of the nut 50 on the bolt 48 in response to turning of the clamp wheel 52 causes the bracket assembly 54 to move upwardly, thus pivoting the arm 46 about the horizontal axis 60. The chair seat back is thereby moved to and maintained in an adjusted degree of tilt with respect to the support member 20.

During normal load conditions, a force is applied to the chair seat back with tends to rotate the frame 46 and the support member 20 about the horizontal axis 22. This movement causes the end portions 31 of the torsion bars 26 to deflect downwardly (FIGS. 2 and 4), thus tending to rotate the body portions 28 of the torsion bars 26 in a clockwise direction as viewed in FIG. 4. Such movement also causes the opposite end portions 30 of the torsion bars 26 to deflect downwardly. However, engagement of the end portions 30 with the bracket assembly 32 prevents such downward movement and causes the torsion bars 26 to twist between the end portions 30 and 31 thereof. Resistance to such twisting movement inherent in the metal used to form the torsion bars 26 thus allows for yieldable support of the support member 20 on the frame member 18. Operation of the torsion bar adjustment member 13 causes the end portions 30 to deflect upwardly or downwardly so as to pretwist the torsion bars 26 and therefore adjust the magnitude of the resistance to pivotal movement offered by the torsion bars 26.

From the above description, it is seen that the seat back tilt-adjusting mechanism 10 of this invention provides a means for adjusting the resting (no-load) position of a swivel chair seat back relative to the chair seat. When used in combination with chair control mechanisms 13 employing metal torsion bars 26, the mechanism 10 can be operated so as to move the chair seat back in a clockwise direction about the axis 60 so as to compensate for relaxation of the chair back caused by metal creep in the torsion bars 26 associated with periods of prolonged use of the chair 12. The mechanism 10 can furthermore be operated in cooperation with the torsion bar adjustment member 24 so as to provide various combinations of seat back resting degrees of tilt and rates of rotation so as to conform the chair 12 to the comfort specifications of chair users.

What is claimed is:

1. A chair seat back tilt-adjusting mechanism comprising a first frame component adapted to be attached to a chair seat member, a second frame component pivotally mounted on said first component for movement relative thereto about a horizontal axis, at least one torsion bar having a body portion and end portions bent transversely thereof, one of said end portions being secured to said second component and the other of said end portions being secured to said first component so that relative pivotal movement of said components causes said torsion bar body portion to twist between said end portions and thereby yieldably resist said relative pivotal movement, a torsion bar adjustment member mounted on said first component and engageable with one of said torsion bar end portions so as to be operable to exert a force on said end portion capable of preloading said torsion bar to thereby adjust the magnitude of resistance applied by said torsion bar to said relative pivotal movement, a third frame component pivotally mounted directly on said second component for movement relative thereto about a horizontal axis and adapted to support a chair seat back, said third frame component being pivotally mounted on said second frame component at a position spaced rearwardly from the position where said second component is pivotally connected to said first component, and adjustable means engaging said third component secured to said second component so as to be operable to move said third component about said axis to an adjusted position, said adjustable means comprising coacting nut and bolt means secured to said second frame component and to said third frame component at a position thereon displaced radially from said horizontal axis so that operation of said assembly results in pivoting of said third frame component about said axis, said nut and bolt means including a bolt secured to said second frame component, a nut threadably mounted on said bolt, and a bracket assembly fixedly secured to said third frame component and positioned on said bolt for longitudinal movement relative thereto, said bracket assembly being engaged with said nut so that turning of said nut is operable to move said bracket assembly upwardly or downwardly relative to said bolt and thus pivot said third frame component about said horizontal axis, and spring means disposed between said second frame component and said bracket assembly so as to urge said third frame component in one direction relative to said axis.

2. A chair seat back tilt-adjusting mechanism according to claim 1 wherein said torsion bar body portion extends longitudinally of said chair seat member.

* * * * *